US008308394B2

(12) United States Patent
Whitley

(10) Patent No.: US 8,308,394 B2
(45) Date of Patent: Nov. 13, 2012

(54) VACUUM-OPERATED MATERIAL TRANSFER SYSTEM AND METHOD

(75) Inventor: Ralph E. Whitley, Huntersville, NC (US)

(73) Assignee: VT LeeBoy, Inc., Lincolnton, NC (US)

( * ) Notice: Subject to any disclaimer, the term of this patent is extended or adjusted under 35 U.S.C. 154(b) by 104 days.

(21) Appl. No.: 12/705,873

(22) Filed: Feb. 15, 2010

(65) Prior Publication Data

US 2011/0200389 A1 Aug. 18, 2011

(51) Int. Cl.
*E01C 19/12* (2006.01)

(52) U.S. Cl. ..... 404/75; 404/72; 404/83; 404/101; 404/107; 404/108; 404/109; 404/111; 406/127

(58) Field of Classification Search ..... 404/83–85, 404/110, 111, 72, 75; 406/127
See application file for complete search history.

(56) References Cited

U.S. PATENT DOCUMENTS

| | | | | |
|---|---|---|---|---|
| 4,411,389 | A | 10/1983 | Harrison | |
| 4,474,327 | A | 10/1984 | Mattson et al. | |
| 4,538,941 | A | 9/1985 | Thorne | |
| 4,630,929 | A * | 12/1986 | Medlin | 366/10 |
| 4,678,363 | A | 7/1987 | Sterner | |
| 5,071,289 | A * | 12/1991 | Spivak | 406/11 |
| 5,181,349 | A | 1/1993 | Schaffer | |
| 5,252,008 | A | 10/1993 | May, III et al. | |
| 5,263,790 | A | 11/1993 | Bickley et al. | |
| 5,407,299 | A * | 4/1995 | Sutton | 404/75 |
| 5,419,654 | A * | 5/1995 | Kleiger | 404/101 |
| 5,846,031 | A | 12/1998 | Rutz | |
| 6,012,875 | A | 1/2000 | Goettelmann et al. | |
| 6,089,795 | A | 7/2000 | Booth | |
| 6,230,636 | B1 | 5/2001 | Bom et al. | |
| 6,883,736 | B1 | 4/2005 | Blatt | |
| 7,080,961 | B1 | 7/2006 | Blatt | |
| 2008/0031688 | A1 * | 2/2008 | Gilchrist | 404/108 |
| 2009/0112411 | A1 | 4/2009 | Gilchrist | |
| 2011/0091333 | A1 * | 4/2011 | Krohn | 417/120 |

* cited by examiner

*Primary Examiner* — Raymond W Addie
(74) *Attorney, Agent, or Firm* — Matthew W. Witsil; Moore & Van Allen PLLC

(57) ABSTRACT

Embodiments of the present invention relate to systems and methods implemented in a pothole patching system for creating a vacuum that pulls heavy particulate, such as gravel, out of a hopper. For example, according to an embodiment, a vacuum body having a vacuum chamber formed therein is positioned proximate to an opening of the hopper. A moveable slide gate is provided between the vacuum chamber and the opening of the hopper. The slide gate moves between open and closed positions for permitting and blocking communication between the vacuum chamber and the hopper. A reduction nozzle is provided between an air source and the vacuum chamber. Forced air flows from the air source, through the reduction nozzle, and into the vacuum chamber. The reduction nozzle reduces the pressure of the forced air entering the vacuum chamber, and thereby creates a vacuum in the vacuum chamber. When the slide gate is in the open position, this vacuum pulls particulate from the hopper.

31 Claims, 12 Drawing Sheets

VACUUM-OPERATED MATERIAL TRANSFER SYSTEM AND METHOD

FIELD

The present invention relates generally to systems and methods for transferring particulate and, more particularly, to systems and methods implemented on a vehicle-supported pothole patcher for creating a vacuum that pulls aggregate, such as gravel or crushed rock, out of a hopper in a reliable manner.

BACKGROUND

Pothole patchers are designed to repair potholes that have formed in road surfaces by filling the potholes with a mixture of aggregate and hot emulsion. A pothole patcher is commonly mounted on a chassis of a motor vehicle and includes a hopper for storing aggregate, an emulsion tank for storing emulsion, a motor-driven hydraulic pump for blowing forced air, and a boom having a spray nozzle for spraying a mixture of emulsion and aggregate. A conduit or a series of conduits typically extends between the hydraulic pump, the hopper, and the boom. In operation, aggregate drops from the hopper into the conduit, where forced air provided by the hydraulic pump entrains and carries the aggregate to the boom. The aggregate is mixed with emulsion in the boom and the spray nozzle sprays the mixture of emulsion and aggregate into a pothole.

In some known pothole patchers, the hopper is pressurized to help aggregate move down through the hopper, out through a bottom outlet of the hopper, and into the conduit. Pressurizing the hopper prevents aggregate from clogging the bottom outlet of the hopper and facilitates a steady flow of aggregate into the conduit. However, pressurizing the hopper requires a hopper design and additional components that are expensive and subject to failure.

For example, oftentimes a gasket is provided between a lid and a top rim of the hopper to seal the hopper and thereby enable pressurization. This gasket wears over time and becomes less efficient, and may eventually require replacement. In some cases, when the lid is closed, aggregate may get trapped on the gasket, between the lid and the top rim of the hopper. The trapped aggregate accelerates wear of the gasket. What's more, to pressurize the hopper, forced air is sometimes routed from the hydraulic pump to the inside of the sealed hopper and thereby puts additional load on the motor-driven hydraulic pump, which, in addition to wearing the pump, requires additional fuel and thereby increases the overall cost of repairing potholes. To withstand pressurization, the hopper must be constructed of heavy duty components. However, even when constructed of heavy duty components, hoppers are subject to failure when pressurized. Failure due to pressurization may be dangerous. For example, an explosion-like failure may propel components away from the hopper at high rates of speed. The propelled components may cause injury or damage property.

In other known pothole patchers, an auger or screw conveyor is provided in the hopper for guiding aggregate down the hopper and pushing aggregate through the bottom outlet and into the conduit. Augers and screw conveyors are rotating implements powered by hydraulic motors. Further, in other known pothole patchers, a vibrator is provided on or within the hopper to agitate the aggregate to prevent the aggregate from amalgamating and sticking to the inner walls of the hopper and to facilitate flow of aggregate down the hopper and out through the bottom outlet. However, like pressurizing the hopper, installing an auger, a screw conveyer, and/or a vibrator requires additional components, including moving components that are subject to failure and that are expensive to repair and maintain. Further, a hopper equipped with an auger, a screw convey, and/or a vibrator is still subject to clogging. For example, aggregate in the hopper could jam the rotating auger or screw conveyor and thereby clog the hopper and prevent aggregate from dropping in to the conduit. In this event, because the auger is not easily accessible, an operator may be tempted to climb into the hopper and attempt to free the auger or screw conveyor. However, climbing into the hopper is dangerous because the auger or screw conveyor may resume operation while the operator is still in the hopper.

Also, in some known pothole patchers, to control movement of the boom and delivery of emulsion and aggregate, operators must use both hands to flip switches and depress buttons on separate consoles. Further, in some cases, operators must exit the operator cabin to access various controls mounted along the chassis of the vehicle. For example, the operator may have to exit the operator cabin to access controls that control the speed of the motor-driven hydraulic pump, the pressure inside of the emulsion tank and/or hopper, the position of valves that permit and block the flow of emulsion and aggregate, and the position of the boom.

BRIEF SUMMARY OF EMBODIMENTS OF THE INVENTION

Embodiments of the present invention relate to systems and methods implemented on a pothole patcher for creating a vacuum that pulls heavy aggregate, such as gravel or crushed rock, out of a hopper and into a flow path of forced air that entrains and carries the aggregate through a conduit and to a boom assembly. The systems and methods described herein pull heavy aggregate out of the hopper at a controlled rate and in a reliable manner, without the use of moving parts, such as an auger or a conveyor screw, and without having to pressurize the hopper. The systems and methods described therein provide an economical, low-maintenance, and efficient alternative to the traditional methods of pressurizing the hopper or equipping the hopper with a hydraulically powered rotating implement.

Specifically, according to an embodiment of the invention, a system is provided for use on a pothole patcher for creating a vacuum that pulls particulate out of a hopper and into a flow path of forced air that is provided by an air source. According to this embodiment, the system comprises: a vacuum chamber formed in a vacuum body and disposed proximate to the hopper; a valve disposed between the vacuum chamber and the hopper, the valve configured to open and close for permitting and blocking communication between the vacuum chamber and the hopper; and a reduction nozzle provided between the air source and the vacuum chamber, the reduction nozzle creates a vacuum in the vacuum chamber by reducing the pressure of the forced air entering the vacuum chamber; wherein the vacuum pulls particulate from the hopper to the vacuum camber when the valve is open.

In another embodiment of the invention, a vacuum-operated material transfer system is provided for use on a pothole patcher, where the pothole patcher is equipped with a hopper for storing particulate, such as gravel or crushed rock, an air source for providing a flow path of forced air, and a boom assembly for dispensing particulate, the vacuum-operated material transfer system is configured to create a vacuum that pulls particulate out of an outlet of the hopper and into the flow path of forced air provided by the air source, the forced air entrains and carries particulate to the boom assembly.

According to this embodiment, the system comprises a vacuum body disposed proximate to the outlet of the hopper, the vacuum body comprises: a vacuum chamber; a surface disposed between the vacuum chamber and the hopper; and an opening formed in the surface and positioned inline with the outlet of the hopper, the opening provides communication between the hopper and the vacuum chamber. According to this embodiment, the system further comprises: a slide gate slidably mounted on the surface of the vacuum body and movable between open and closed positions, the open position permits communication between the hopper and the vacuum chamber, the closed position blocks communication between the hopper and the vacuum chamber; a reduction nozzle disposed between the vacuum chamber and the air source, the reduction nozzle is configured to create the vacuum inside of the vacuum chamber by reducing the pressure and increasing the velocity of the forced air flowing from the air source into the vacuum chamber, the vacuum pulls particulate through the outlet of the hopper, through the opening of the vacuum body, and into the vacuum chamber; and a wide-area opening disposed between the vacuum chamber and the boom assembly, the increased-velocity forced air exiting the reduction nozzle entrains and carries particulate from the vacuum chamber into the wide-area opening and then to the boom assembly.

According to another embodiment of the invention, a method is provided for using a vacuum-operated material transfer system that is installed on a pothole patcher, the pothole patcher comprises a hopper for storing particulate, such as gravel or crushed rock, an air source for providing a flow path of forced air, and a boom assembly for dispensing particulate. According to this embodiment, the method comprises: creating a low-pressure area inside of a vacuum chamber that is formed in a vacuum body and disposed proximate to an outlet of the hopper by controlling the air compressor to provide the flow path of forced air through a reduction nozzle and into the vacuum chamber; and permitting the low-pressure area inside of the vacuum chamber to pull particulate from the hopper by opening a valve that is disposed between the vacuum chamber and the hopper and that is configured to open and close for permitting and blocking communication between the vacuum chamber and the hopper.

According to another embodiment of the invention, a pothole patching system is provided mounted on a vehicle having a wheeled chassis, the pothole patching system comprises: a boom assembly mounted on an end of the wheeled chassis and having a boom outlet on an end thereof; a hopper in communication with the boom assembly and configured to store aggregate; an air source in communication with the boom assembly and the hopper and configured to provide a flow path of forced air that carries aggregate from the hopper to the boom assembly; and a vacuum-operated material transfer system that creates a vacuum proximate to an outlet of the hopper that pulls particulate out of the hopper and into the flow path of forced air provided by the air source. According to this embodiment, the vacuum-operated material transfer system comprises: a vacuum chamber formed in a vacuum body and disposed proximate to the outlet of hopper; a valve disposed between the vacuum chamber and the outlet of hopper, the valve configured to open and close for permitting and blocking communication between the vacuum chamber and the hopper; and a reduction nozzle provided between the air source and the vacuum chamber and configured to create the vacuum in the vacuum chamber by reducing the pressure of the forced air entering the vacuum chamber, wherein the vacuum created by the vacuum-operated material transfer system pulls particulate from the outlet of the hopper to the vacuum camber and the flow path of forced air provided by the air source entrains and carries particulate to the boom outlet of the boom assembly.

According to another embodiment of the invention, a method is provided for using a joystick to control a pothole patching system to repair a road surface, wherein the pothole patching system includes a hopper for storing aggregate, an emulsion tank for storing emulsion, a hydraulic pump for providing a flow path of forced air, and a boom assembly for delivering emulsion and aggregate to a repair area of the road surface. According to this embodiment, the method comprises: moving the joystick to move the boom assembly to a position over the repair area; squeezing a trigger of the joystick to direct the flow path of forced air out of the boom assembly and to the repair area; providing a coat of emulsion on a surface of the repair area by pushing a first pushbutton of the joystick to open a valve associated with the emulsion tank and permit emulsion to flow out of the boom assembly and to the repair area; filling the repair area with a mixture of emulsion and aggregate by pushing a second pushbutton of the joystick to open a valve associated with the hopper and permit the flow path of forced air to carry aggregate out of the boom assembly and to the repair area, wherein emulsion and aggregate are flowing from the boom assembly to the repair area; providing a layer of aggregate on top of the mixture of emulsion and aggregate by pushing the first pushbutton of the joystick to close the valve associated with the emulsion tank, wherein the flow path of forced air continues to carry aggregate out of the boom assembly and to the repair area; and pushing the second pushbutton of the joystick to close the valve associated with the hopper and stop the flow of aggregate out of the boom assembly.

BRIEF DESCRIPTION OF THE SEVERAL VIEWS OF THE DRAWINGS

Figure 1:
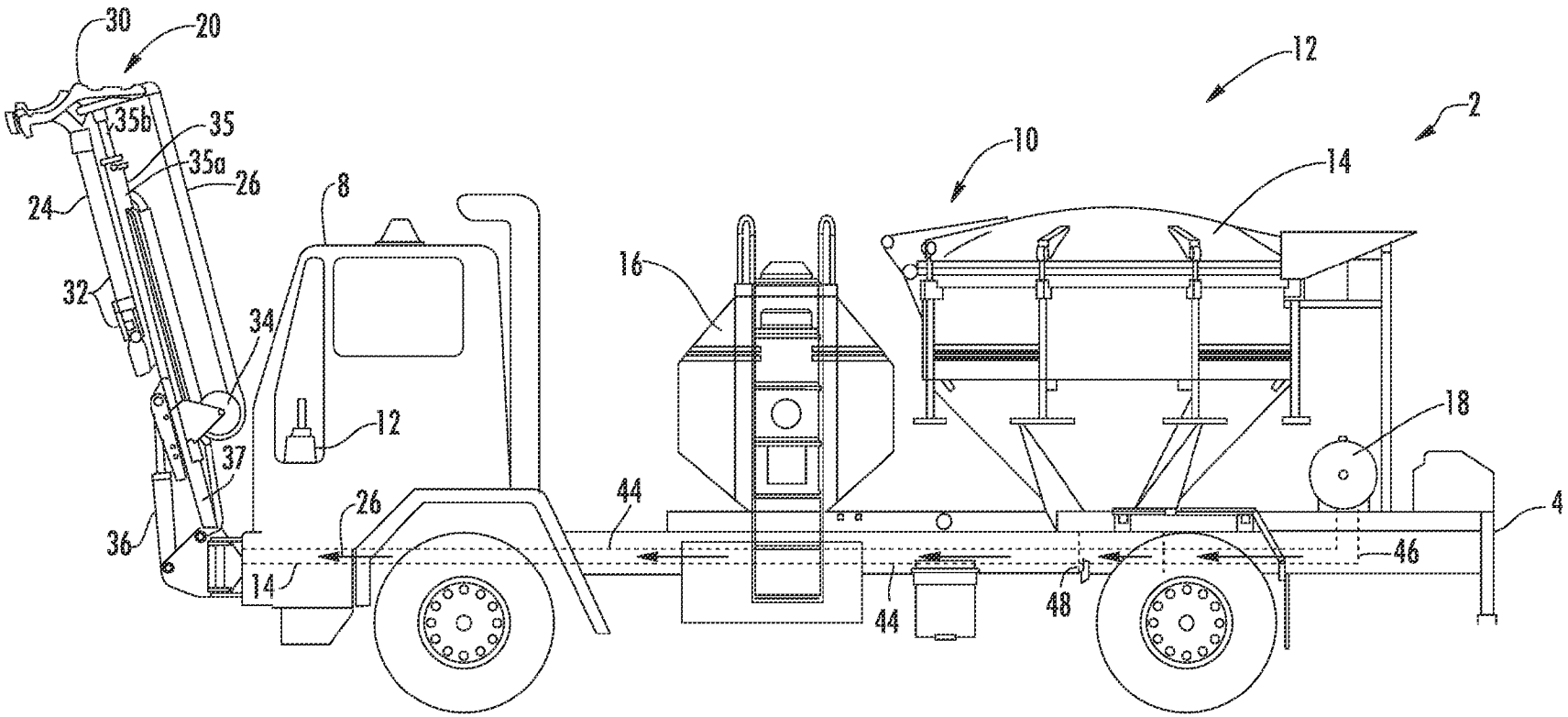
Figure 2:
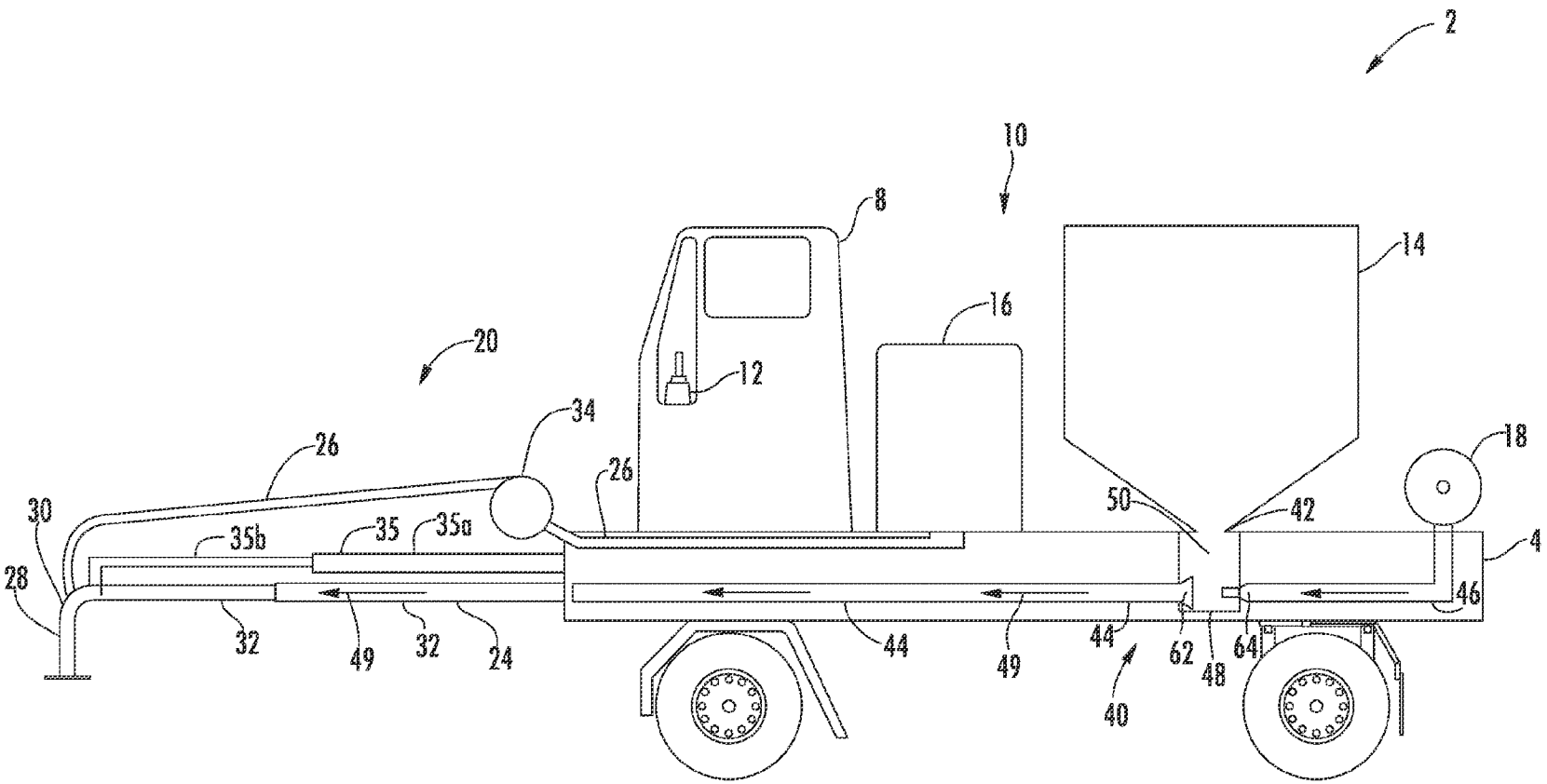
Figure 3:
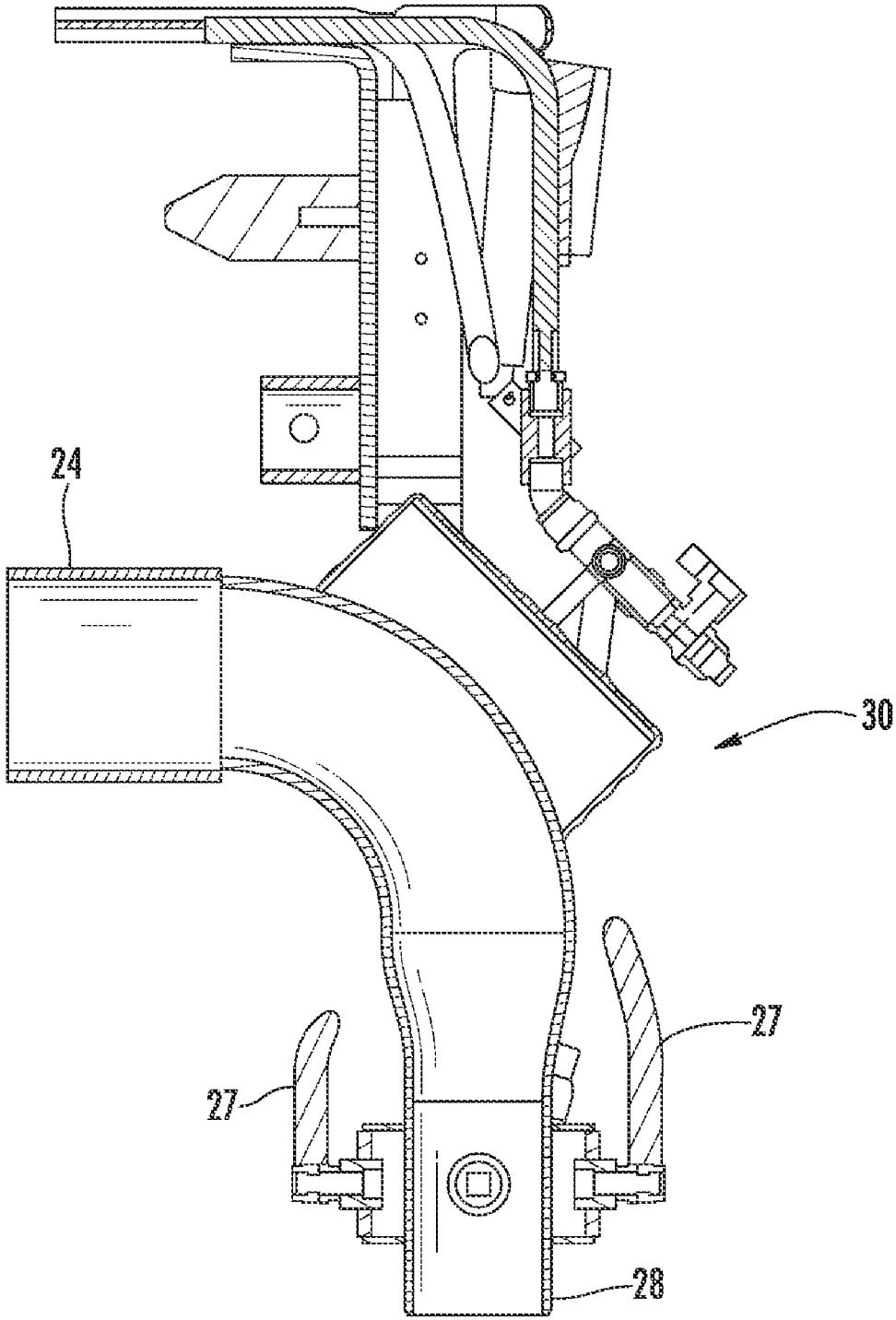
Figure 4:
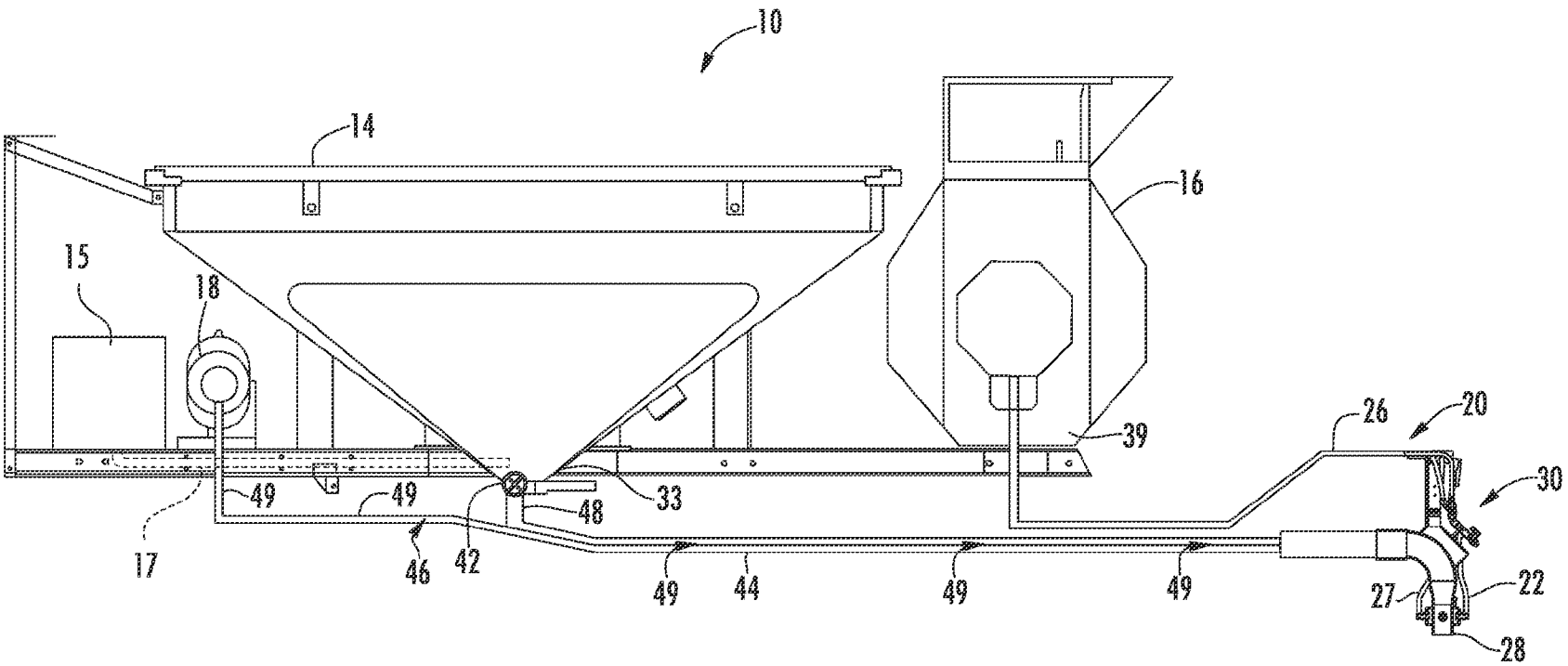
Figure 5:
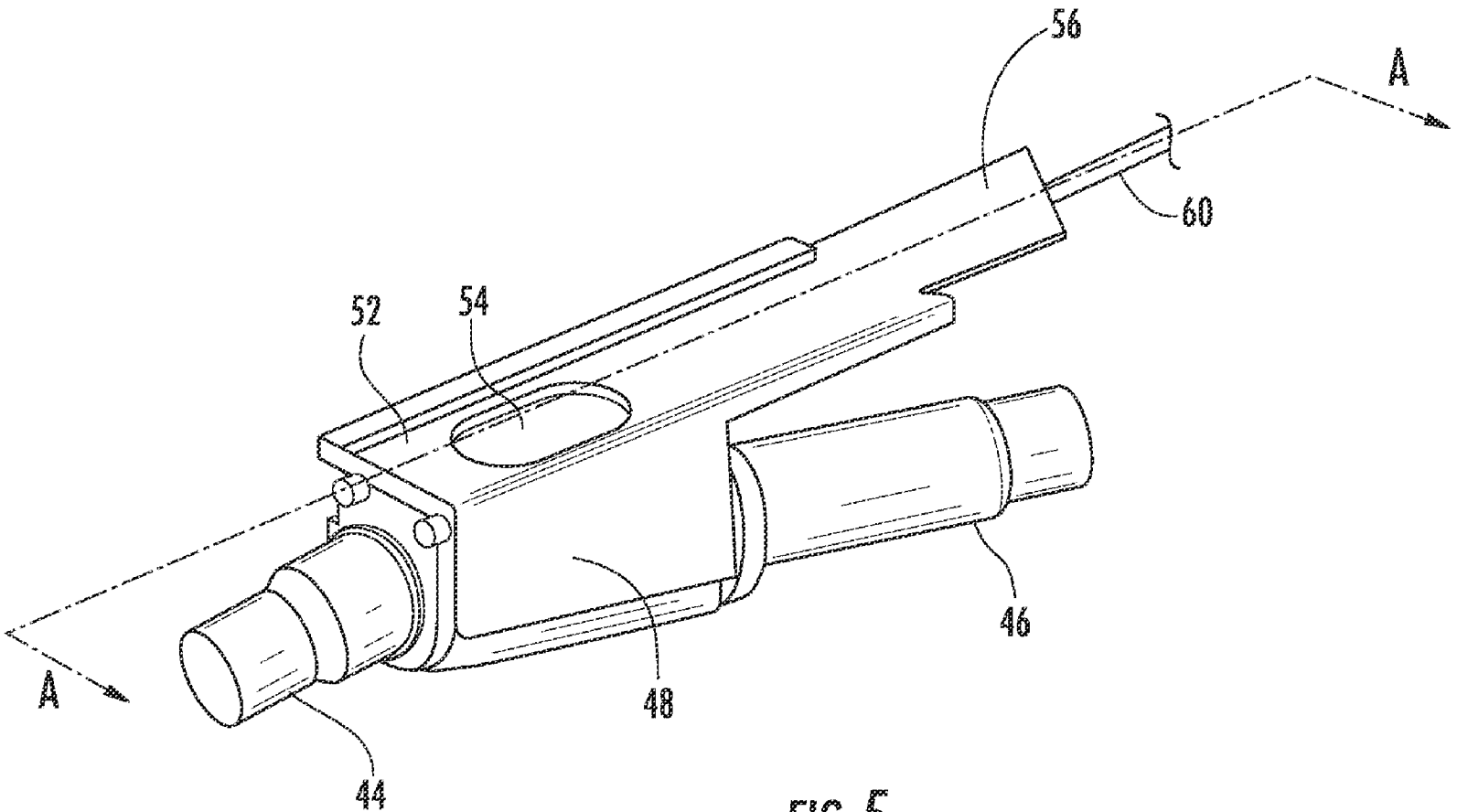
Figure 6:
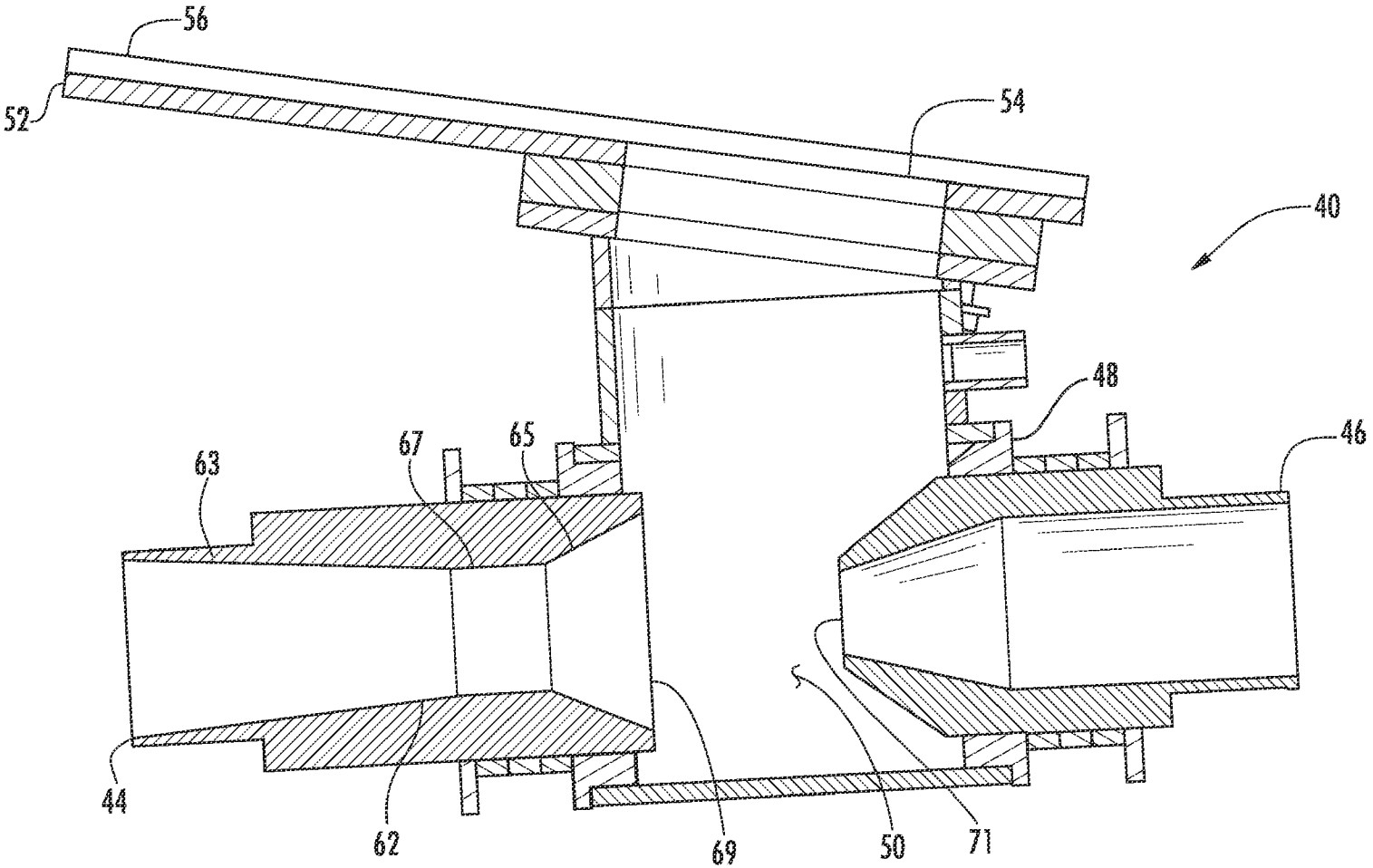
Figure 8:
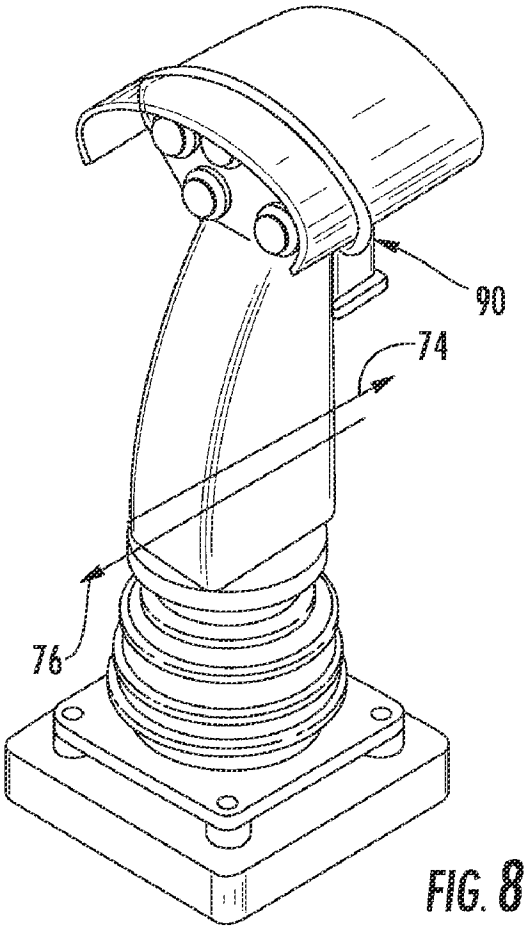
Figure 7:
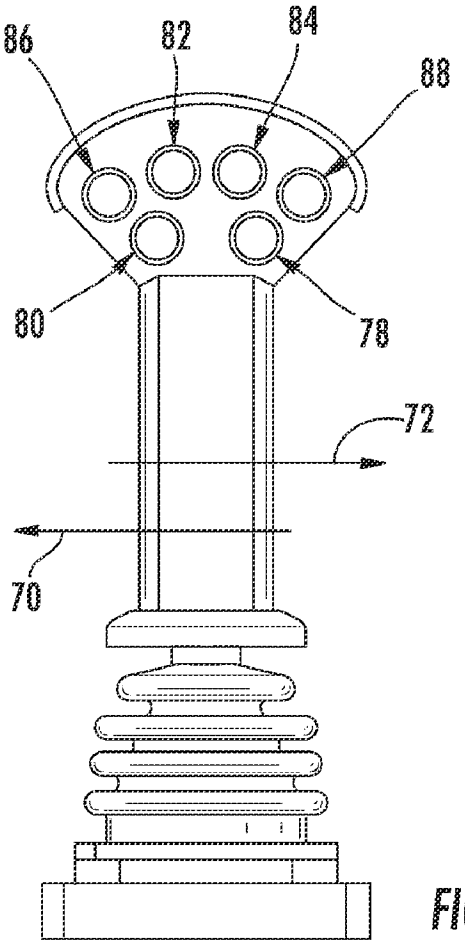
Figure 9:
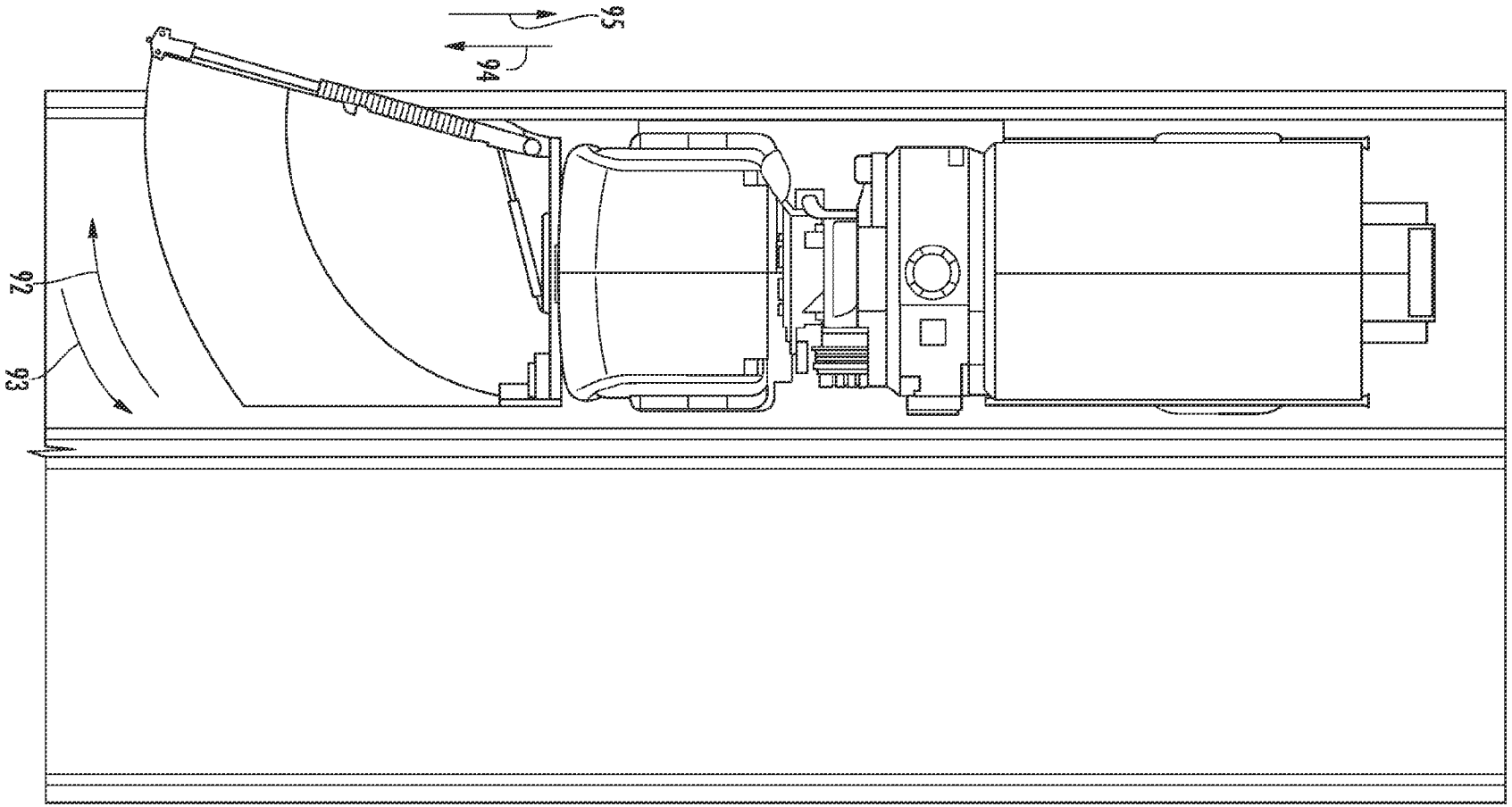
Figure 10:
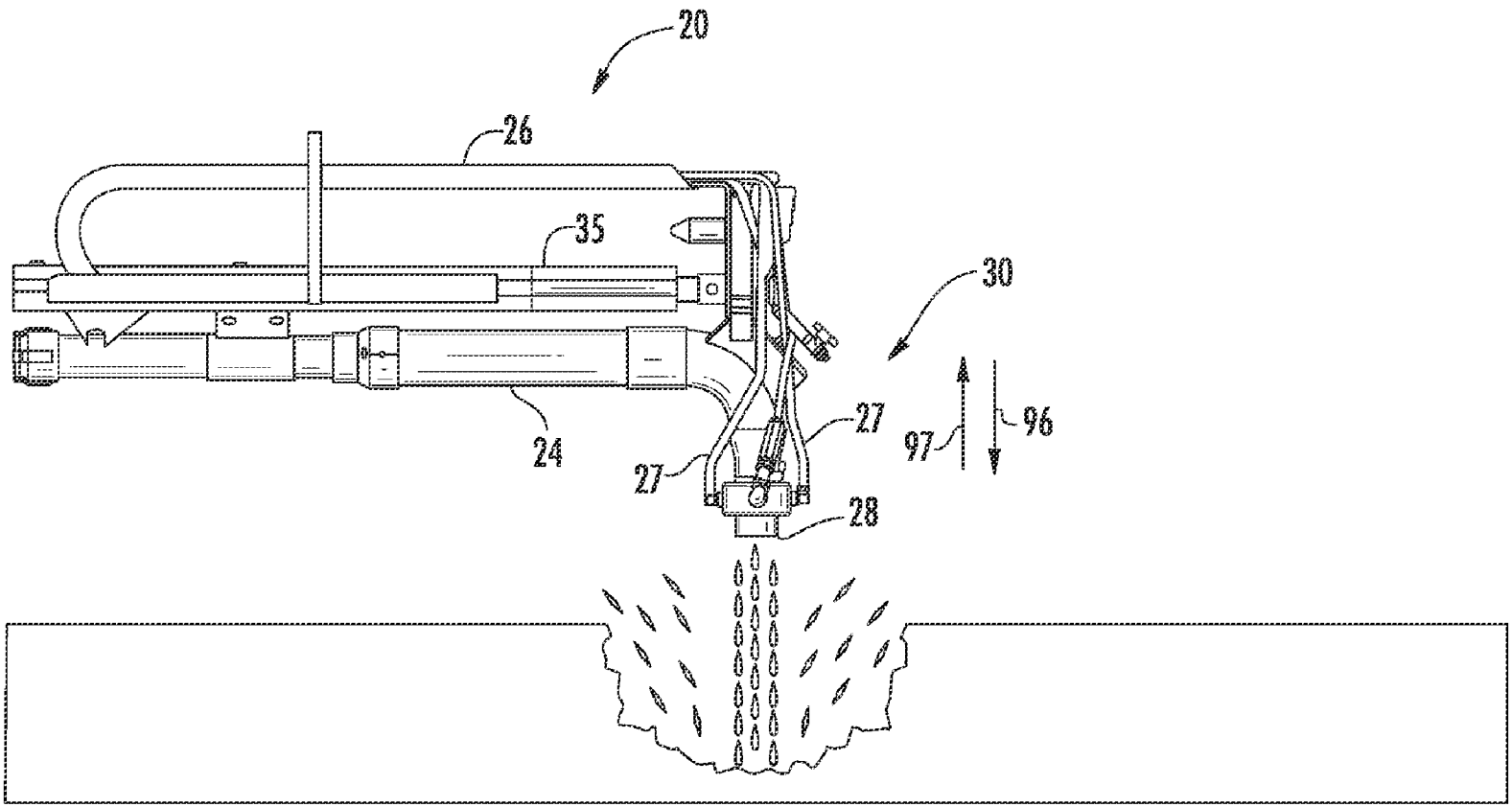
Figure 11:
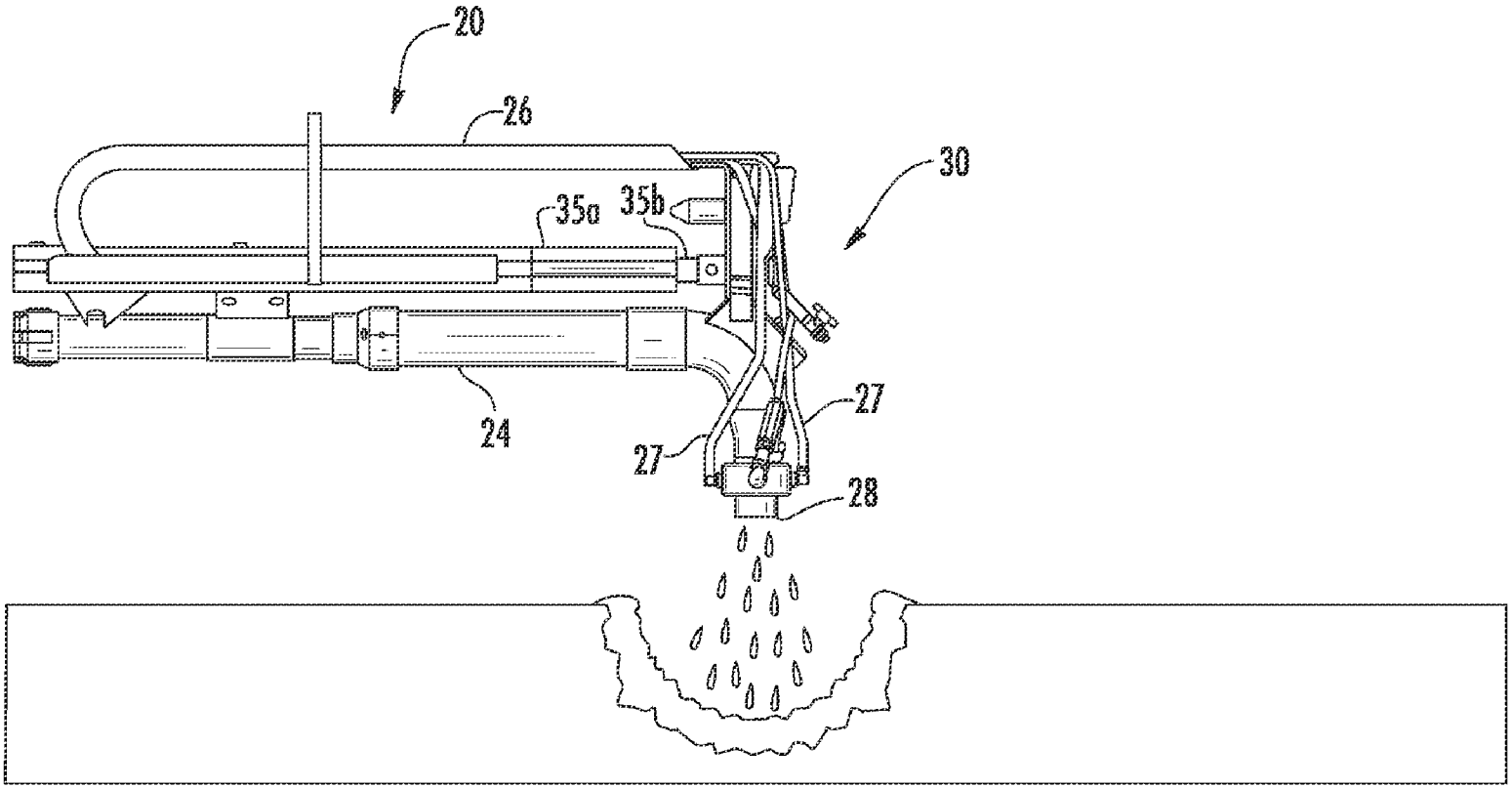
Figure 12:
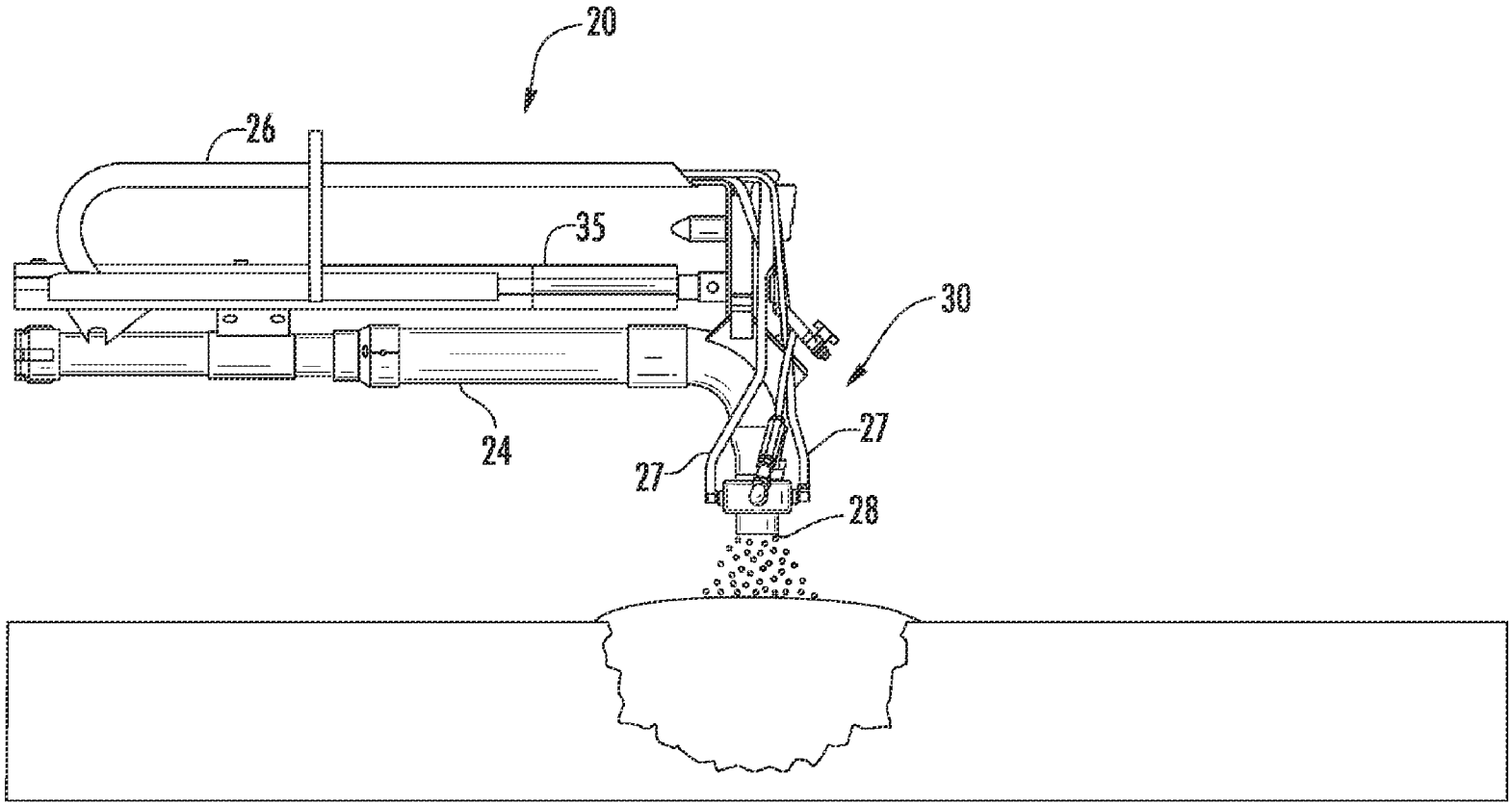
Figure 13:
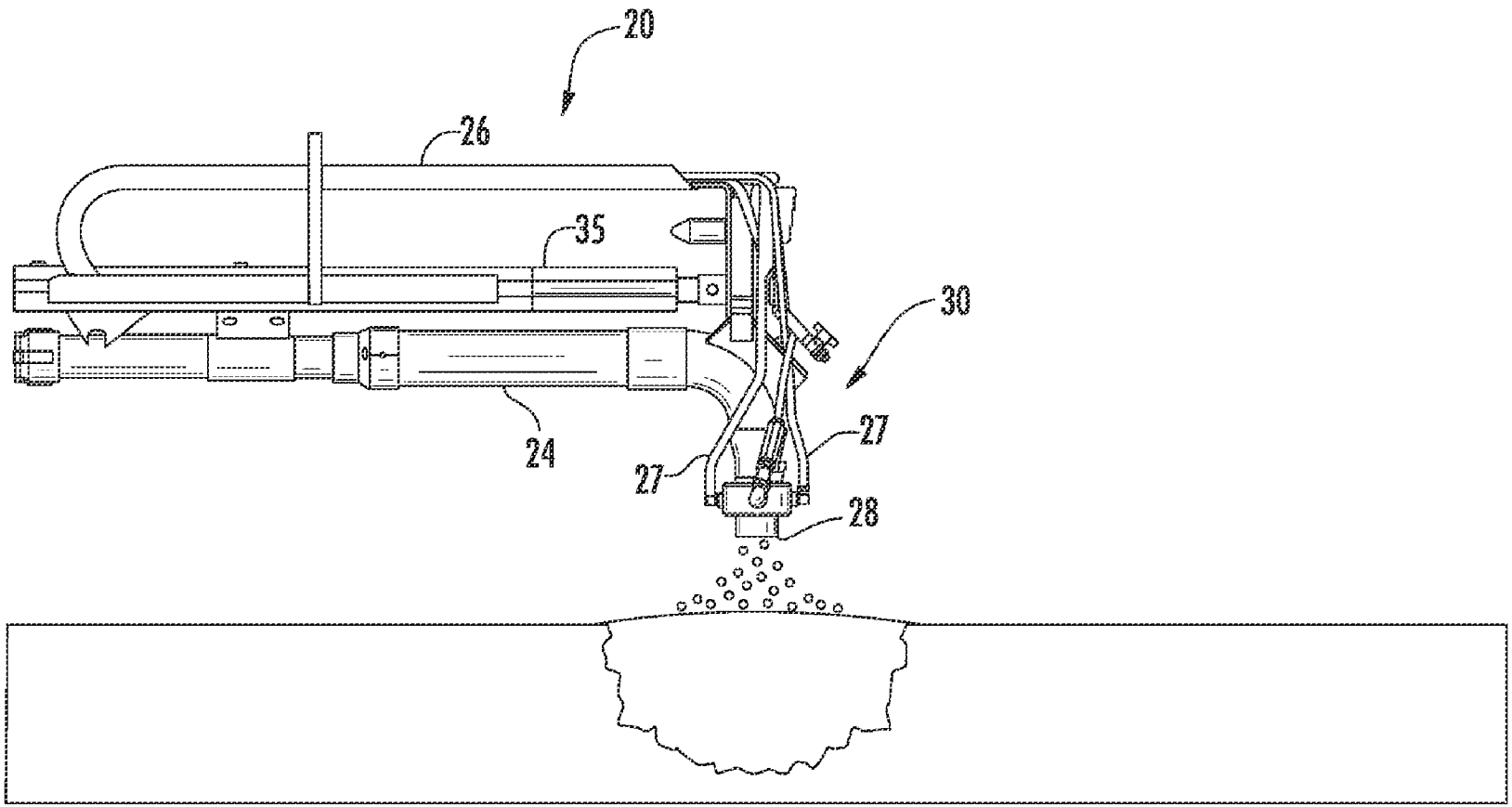

Having thus described embodiments of the invention in general terms, reference will now be made to the accompanying drawings, which are not necessarily draw to scale, and wherein:

FIG. 1 is a side view of an exemplary pothole patching system mounted on a mobile pothole patcher, according to an embodiment;

FIG. 2 is another side view of the pothole patching system of FIG. 1 mounted on the mobile pothole patcher, according to an embodiment;

FIG. 3 is a sectional side view of an end of a boom assembly mounted on the mobile pothole patcher of FIG. 1, according to an embodiment;

FIG. 4 is a schematic side view, with portions removed, that illustrates the flow of forced air, aggregate, and emulsion in the pothole patching system of FIG. 1, according to an embodiment;

FIG. 5 is a perspective view, with portions removed, of an exemplary vacuum-operated material transfer system for use in the pothole patching system of FIG. 1, according to an embodiment;

FIG. 6 is a section side view taken along A-A of the vacuum-operated material transfer system of FIG. 5, according to an embodiment;

FIG. 7 is a plane rear view of a joystick for operating the pothole patching system of FIG. 1, according to an embodiment of the present invention;

FIG. 8 is a perspective rear view of the joystick of FIG. 7, according to an embodiment of the present invention;

FIG. 9 is a top view of the exemplary mobile pothole patcher of FIG. 1 for illustrating an exemplary range of motion for a telescoping boom assembly, according to an embodiment;

FIG. 10 is a side view of the boom assembly of FIG. 3 for illustrating an exemplary operation of the mobile pothole patcher of FIG. 1, according to an embodiment;

FIG. 11 is another side view of the boom assembly of FIG. 3 for illustrating an exemplary operation of the mobile pothole patcher of FIG. 1, according to an embodiment;

FIG. 12 is yet another side view of the boom assembly of FIG. 3 for illustrating an exemplary operation of the mobile pothole patcher of FIG. 1, according to an embodiment; and FIG. 13 is still another side view of the boom assembly of FIG. 3 for illustrating an exemplary operation of the mobile pothole patcher of FIG. 1, according to an embodiment.

DETAILED DESCRIPTION OF EMBODIMENTS OF THE INVENTION

Embodiments of the present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

FIGS. 1-3 illustrate an exemplary pothole patcher 2 for repairing potholes that have formed in road surfaces by filling the potholes with a mixture of emulsion and aggregate, in accordance with an embodiment of the present invention. The mobile pothole patcher 2 comprises a wheeled chassis 4 that supports an operator cabin 8 and a pothole patching system 10. The operator cabin 8 is equipped with a joystick 12 that enables a single operator to use a single hand to control operation of the pothole patching system 10 from within the cabin 8. The pothole patching system 10 includes a hopper 14 for storing aggregate, a pressurized emulsion tank 16 for storing emulsion, and an air source 18, such as a motor-driven hydraulic pump, for blowing forced air that delivers aggregate to a boom outlet 28 mounted at an end 30 of a telescoping boom assembly 20.

In some cases, the emulsion tank 16 maintains the emulsion in a predetermined temperature range, because, if the emulsion gets too cold, it will thicken thereby making it difficult to apply the emulsion to repair a road surface. Unlike the emulsion, aggregate may be applied to repair a road surface, regardless of its temperature. However, when the ambient temperature approaches freezing, ice and slush may form in the aggregate and on components of the hopper 14. This ice and slush may slow the flow rate of aggregate exiting the hopper 14. In some cases, the ice and slush can completely clog the hopper 14. Either of these conditions may delay or prevent road-repair operations.

To maintain the emulsion tank 16 at working temperature, the primary truck engine coolant is routed via a series of conduits (not shown) through the emulsion tank 16. Thus, when the truck engine is running, the emulsion tank 16 maintains a constant temperature. When the truck is parked overnight or shut down for extended periods of time, the emulsion tank 16 is equipped with an electrical thermostatically controlled heating coil capable of using outside 220V or 460V power. Additionally, as illustrated in FIG. 4, an embodiment of the pothole patching system 10 includes an end-mounted diesel-powered engine 15, which, in addition to providing power to hydraulic subsystems, provides hot engine exhaust to the hopper 14 for the purpose of warming the aggregate stored therein. More specifically, according to the illustrated embodiment, an exhaust conduit 17 extends between the diesel-powered engine 15 and the inside of the hopper 14. When the diesel-powered engine 15 is operating, hot engine exhaust passes from the engine, through the conduit 17, and into the hopper 14. The hot engine exhaust heats the hopper 14 and the aggregate stored therein and thereby melts any ice or slush (or moisture) that may have formed in the aggregate and on the components of the hopper 14.

The boom assembly 20 is mounted at the front of the chassis 4 and, in addition to the boom outlet 28, supports an aggregate-delivery tube 24 and a flexible emulsion hose 26. The aggregate-delivery tube 24 delivers aggregate along the length of the boom assembly 20 to the boom outlet 28, whereas the flexible emulsion hose 26 delivers emulsion along the length of the boom assembly 20. As illustrated in FIGS. 3 and 4, in one embodiment, the emulsion hose 26 splits into multiple branch hoses 27 at the end 30 of the boom assembly 20. The branch hoses 27 are spaced around the circumference of the boom outlet 28 in order to radially deliver emulsion into the boom outlet 28 in a uniform manner. If forced air and aggregate are passing through the boom outlet 28, then the branch hoses 27 radially inject emulsion into the forced air and aggregate, thereby resulting in a mixture of emulsion and aggregate being expelled from the boom outlet 28. However, if only forced air is passing through the boom outlet 28, then the branch hoses 27 radially inject emulsion into the forced air, thereby resulting in emulsion, without aggregate, being expelled from the boom outlet 28.

In either event, this arrangement, where branch hoses 27 radially deliver emulsion into the boom outlet 28, is better than having two separate outlets/nozzles—one outlet/nozzle for aggregate and another outlet/nozzle for emulsion—because this arrangement mixes emulsion with aggregate before the emulsion and aggregate are expelled from the boom assembly 20. Accordingly, the emulsion and aggregate are already mixed when delivered to the pothole, thereby eliminating any need for the operator to exit the cabin 8 and manually mix the emulsion and aggregate after the emulsion and aggregate have been delivered to the pothole.

The boom assembly 20 is supported, in part, by an extension piston-and-cylinder device 35 having a cylinder 35*a* and a piston 35*b*. The piston 35*b* extends outwardly from and retracts inwardly toward the cylinder 35*a*, and thereby moves the boom outlet 28 between a retracted position, as shown in FIG. 1, and an extended position, as shown in FIG. 2. The aggregate-delivery tube 24 is formed of multiple telescoping sections 32 so that it can extend and retract with the piston-and-cylinder device 35. Further, an adequate amount of the emulsion hose 26 is provided in a retractable cable track system 34, such as a flexible C-channel track. As the piston-and-cylinder device 35 extends, the retractable track system 34, including the emulsion hose 26, extends accordingly. And, as the piston-and-cylinder device 35 retracts, the emulsion hose 26 and the retractable track system 34 retract accordingly.

In addition to extending and retracting, the boom assembly 20 pivots up and down by the action of a vertical piston-and-cylinder device 36. Further, the boom assembly 20 pivots from side-to-side by the action of a lateral piston-and-cylinder device 37. As described in detail below, by moving the joystick 12 provided in the cabin 8 of the mobile pothole patcher 2, an operator can control the piston-and-cylinder devices 35, 36, 37 and thereby cause the boom outlet 28 of the boom assembly 20 to move throughout a range of positions.

Referring now to FIG. 4, a brief operational overview of the pothole patching system 10 will be provided. FIG. 4 is a schematic side view, with portions removed, that illustrates the flow of forced air, aggregate, and emulsion in the pothole patching system 10, according to an embodiment. The motor-driven hydraulic pump 18 provides a flow path of forced air through pothole patching system 10 in the manner illustrated by arrow 49. The flow path 49 of forced air flows from motor-driven hydraulic pump 18, past a bottom outlet 42 of the hopper 14, and out through the boom outlet 28.

As schematically represented in FIG. 4, a valve 33 is provided between the inside of the hopper 14 and the boom outlet 28. When open, the valve 33 permits aggregate to pass from the hopper 14, into the flow path 49 of forced air, and out through the boom outlet 28. Further, a valve 39 is provided between the pressurized emulsion tank 16 and the boom outlet 28. When the valve 39 is open, pressure inside of the pressurized emulsion tank 16 pushes emulsion from the emulsion tank 16, through the emulsion hose 26, and out through the boom outlet 28.

Operation of the mobile pothole patcher 2 will now be described with reference to FIGS. 1-4. To patch a pothole, an operator positions the mobile pothole patcher 2 proximate to a pothole. Then, the operator deploys the boom assembly 20 to a position over the pothole. The operator then activates the motor-driven hydraulic pump 18 to provide the flow path 49 of the forced air—free of emulsion and aggregate—out through the boom outlet 28 and into and across the pothole. The forced air removes dust, water, dirt, debris, and loose particulate from the pothole and provides a clean surface for laying an emulsion coating. Next, to lay the emulsion coating, the operator opens valve 39. Emulsion flows from the emulsion tank 16, through the open valve 39, and to the boom outlet 28, where the flow path 49 of forced air entrains and carries emulsion out of the boom outlet 28 and onto the clean surface of the pothole. Then, to fill the pothole with a mixture of emulsion and aggregate, the operator opens valve 33. Aggregate flows from the hopper 14, through the open valve 33, and into the flow path 49 of forced air, which entrains and carries aggregate to the boom outlet 28. Once at the boom outlet 28, aggregate is mixed with emulsion. The flow path 49 of forced air carries the mixture of emulsion and aggregate out of the boom outlet 28 and into the pothole.

To provide a high-quality patch, the pothole patcher 2 must fill the pothole with the proper mixture of emulsion and aggregate. And to fill a pothole with the proper mixture of emulsion and aggregate, the pothole patching system 10 must consistently provide adequate amounts of emulsion and aggregate to the boom outlet 28. However, some known pothole patching systems are unable to consistently provide adequate amounts of aggregate to the nozzle because they are unable to consistently remove aggregate from the hopper.

For example, some known pothole patching systems rely on gravity to push aggregate down the hopper and out through a bottom opening. However, because aggregate that is suitable for patching potholes typically consists of fairly large and heavy particulate, e.g., flat stones that are one-fourth to three-eighths of an inch in size, and because aggregate tends amalgamate and adhere to the inner walls of the hopper, the force of gravity alone is not always sufficient to push aggregate out through a bottom opening in a uniform manner. Accordingly, in systems that rely on gravity, aggregate may get clogged in the hopper. Further, some known pothole patching systems provide a vibrator within the hopper. The vibrator agitates the aggregate and, to some extent, prevents aggregate from amalgamating and adhering to the inner walls of the hopper. However, in these systems, even though the vibrator prevents aggregate from amalgamating and prevents aggregate from adhering to the inner walls, the force of gravity is still sometimes insufficient to push aggregate down the hopper and out through the bottom opening.

Instead of relying on gravity or a vibrator in combination with gravity to push aggregate down the hopper and out through the bottom opening, other known pothole patching systems provide a rotating implement, such as an auger or a screw conveyor, in the hopper to guide aggregate down the hopper and out through the bottom opening. Still other known pothole patching systems pressurize the hopper so as to force aggregate down the hopper and out through the bottom opening. However, installing rotating implement, such as an auger or screw conveyor, or pressurizing the hopper requires additional components that are subject to failure and that are expensive to maintain and repair.

The vacuum-operated material transfer system 40 of the present invention overcomes the problems in the prior art by creating a vacuum proximate to a bottom outlet 42 of the hopper 14 that pulls aggregate out of the hopper 14. The vacuum-operated material transfer system 40 removes aggregate from the hopper 14 in a reliable manner and enables the pothole patching system 10 to provide adequate amounts of aggregate to the boom outlet 28 and, accordingly, fill a pothole with the proper mixture of emulsion and aggregate, thereby resulting in a high-quality patch. The vacuum-operated material transfer system 40 of the present invention eliminates the ineffectiveness and inconsistency of systems that just rely on gravity or gravity in combination with a vibrator because, unlike those systems that just rely on gravity or gravity in combination with a vibrator, the vacuum-operated material transfer system 40 consistently removes aggregate from the hopper 14 and, accordingly, enables the mobile pothole patcher 2 to consistently fill potholes with the proper mixture of aggregate and emulsion. Further, the vacuum-operated material transfer system 40 eliminates the expense of operating, maintaining, and repairing systems that pressurize the hopper and/or include a rotating implement, such as an auger or screw conveyor. Also, the vacuum-operated material transfer system 40 eliminates the excess weight associated with systems that pressurize the hopper and/or include a rotating implement and thereby reduces the chances that the pothole patcher 2 will subject to applicable Federal Excise Tax Rates based on gross vehicle weight tables.

Referring now to FIGS. 1-6, the vacuum-operated material transfer system 40 will be described in more detail. The vacuum-operated material transfer system 40 includes a vacuum body 48 having a vacuum chamber 50 formed therein. An opening 54, which is formed in a top surface 52 of the vacuum body 48, is provided in communication with the bottom outlet 42 of the hopper 14. Accordingly, the inside of the hopper 14 and the vacuum chamber 50 are in fluid communication. According to an embodiment, the top surface 52 of the vacuum body 48 is part of or attached to the bottom of the hopper 14 such that the opening 54 juxtaposes the bottom outlet 42 of the hopper 14. In another embodiment, the vacuum body 48 is formed integrally with the hopper 14 such that the opening 54 and the outlet 42 are a single opening. In either embodiment, the vacuum chamber 50, including the vacuum created therein, is positioned proximate to the bottom outlet 42 of the hopper 14. According to an embodiment, the opening 54 of the vacuum body 48 is circular and has a diameter of about four inches to about six inches, preferably five inches.

In the illustrated embodiment, a first conduit 44 extends between the vacuum body 48 and the aggregate-delivery tube 24 of boom assembly 20 for establishing communication between the vacuum chamber 50 and the boom outlet 28. A second conduit 46 extends between the vacuum body 48 and the motor-driven hydraulic pump 18 for establishing communication between the vacuum chamber 50 and the hydraulic pump 18. Accordingly, the hydraulic pump 18, the inside of the hopper 14, the vacuum chamber 50, and the boom outlet 28 are all in communication with each other. Although in the illustrated embodiment first and second conduits 44, 46, the bottom outlet 42 of the hopper 14, and the aggregate-delivery tube 24 combine to establish communication between the motor-driven hydraulic pump 18, vacuum chamber 50, the inside of the hopper 14, and the boom outlet 28, it should be appreciated that any number and combination of conduits, tubes, hoses, etc. may be used instead.

A reduction nozzle 64 is disposed on an end of the second conduit 46 and is provided in communication with the vacuum chamber 50. The reduction nozzle 64 reduces the pressure of forced air passing from the second conduit 46, through the reduction nozzle 64, and into the vacuum chamber 50. Accordingly, the reduction nozzle 64 reduces the pressure inside of the vacuum chamber 50. In the illustrated embodiment, the reduction nozzle 64 has a diameter of about two inches to about three inches, preferably 2.62 inches, on its end that is connected to the second conduit 46 for receiving forced air from the motor-driven hydraulic pump 18. On its other end, the reduction nozzle 64 has a nozzle opening 71 that, according to the illustrated embodiment, has a diameter of about 0.75 inch to about two inches, preferably 1.25 inches.

When the motor-driven hydraulic pump 18 is providing forced air through the reduction nozzle 64, the area inside of the vacuum chamber 50 is at a lower pressure than the area inside of the hopper 14, which is at atmospheric pressure. The pressure differential between the lower pressure in the vacuum chamber 50 and the higher, atmospheric pressure in the hopper 14 creates a vacuum inside of the vacuum chamber 50 that pulls aggregate from the hopper 14 when the hopper 14 and the vacuum chamber 50 are in fluid communication.

An air receiving eductor 62 is disposed on an end of the first conduit 44 and is provided in communication with the vacuum chamber 50. According to an embodiment, the eductor 62 includes first and second frusto-conical sections 63, 65 that are interconnected by a middle section 67, which, according to the illustrated embodiment, has a length of about one inch to about two inches, preferably 1.5 inches. The first frusto-conical section 63 has an elongated body having a diameter of about 1.5 inches to about 2.5 inches, preferably about two inches, on one end, which is connected to the middle section 67, and a diameter of about two inches to about 3.5 inches, preferably 2.62 inches, on the other end, which is connected to the first conduit 44. The second frusto-conical section 65 has a length of about one inch to about two inches, preferably 1.5 inches, and a diameter of about one inch to about three inches, preferably two inches, on one end, which is connected to the middle section 67. On its other end, the second frusto-conical section 65 includes a wide-area opening 69 for receiving forced air and aggregate from the vacuum chamber 50. In the illustrated embodiment, the wide-area opening 69 has a diameter of about 2.5 inches to about four inches, preferably 3.37 inches. Also, according to the illustrated embodiment, a gap is provided in the vacuum chamber 50 between the wide-area opening 69 and the opening 71 of the reduction nozzle 64. The gap is about two inches to about four inches, preferably three inches.

A retractable gate 56 is provided on the top surface 52 of the vacuum body 48. As illustrated in FIG. 5, a hydraulically driven shaft 60 is connected to the gate 56. The hydraulically driven shaft 60 slides the gate 56 along the top surface 52 of the vacuum body 48 in a manner that opens and closes off the opening 54, and thereby permits and blocks communication between the vacuum chamber 50 and the inside of the hopper 14. According to an embodiment, valve 33, which is schematically illustrated in FIG. 4, is the opening 54 and the gate 56. That is, the opening 54 and the gate 56 combine to form the schematically illustrated valve 33 of FIG. 4. When the gate 56 is in an open position, as illustrated in FIG. 5, the vacuum chamber 50 and the inside of the hopper 14 are in communication via the opening 54 and aggregate is permitted to flow from the hopper 14 to the vacuum chamber 50. However, when in a closed position, the gate 56 closes off the opening 54 and thereby blocks the flow of aggregate from the hopper 14 to the vacuum chamber 50.

When the gate 56 is open, thereby permitting communication between the hopper 14 and the vacuum chamber 50, and forced air is flowing through the reduction nozzle 64, thereby reducing the pressure inside of the vacuum chamber 50, a vacuum is created in the vacuum chamber 50 that pulls aggregate from the higher-pressure area inside of the hopper 14 to the lower-pressure area inside of the vacuum chamber 50. More particularly, the vacuum pulls aggregate from inside the hopper 14, through the bottom outlet 42 of the hopper 14, through the opening 54 formed in the top surface 52 of the vacuum body 48, and into the vacuum chamber 50. According to some embodiments, the pressure inside of the vacuum chamber 50 ranges from five to negative five pounds-per-square-inch less than the pressure inside of the hopper 14. Once aggregate is in the vacuum chamber 50, the flow path 49 of forced air entrains the aggregate and carries the aggregate into the wide-area opening 52, through the first conduit 44, and on to the aggregate-delivery tube 24 of boom assembly 20.

In an embodiment, the hydraulically driven shaft 60 adjustably controls the position of the gate 56 to vary the amount of aggregate flowing from the hopper 14. For example, the hydraulically driven shaft 60 can vary the position of gate 56 and thereby vary the area of the opening 54. The area of the opening 54, in part, controls the rate at which aggregate flows into the vacuum chamber 50. The larger the area, the higher the rate of flow. As discussed below, the magnitude of the vacuum created in the vacuum chamber 50 also controls the rate at which aggregate flows into the vacuum chamber 50.

It should be appreciated that the schematically illustrated valve 33 of FIG. 4 could be of any type of valve known to those have ordinary skill in the art. For example, instead of using a gate to open and close the opening 54, a ball valve could be provided in the opening 54. The hydraulically driven shaft 60 could be attached to a handle, which could open and close the valve by turning a ball inside the valve. For example, the ball could have a hole formed through the middle so that when the hole is in line with both ends of the valve, the hopper 14 and the vacuum chamber 50 would be in communication and aggregate could flow. The hydraulically driven shaft 60 could also be used to turn the ball such that the hole is perpendicular to the ends of the valve. In this event, the valve would be closed and communication between the inside of the hopper 14 and the vacuum chamber 50 would be blocked.

Also, for example, the schematically illustrated valve 33 of FIG. 4 could be a butterfly valve. In this example, the gate 56 could be circular and sized to fit snuggly within the opening 54. The gate 56 could have a rod passing through its middle that is connected to handle on the outside of the valve. The hydraulically driven stem 60 could rotate the handle, and thereby turn the gate 56 either parallel or perpendicular to the flow of aggregate. Further, it should be appreciated that the gate 56 could be rotated to any position between parallel and perpendicular to variably regulate the flow of aggregate. Further, for example, valve 33 could be a segmented circle that is sized to correspond to the diameter of the opening 54. The hydraulically driven stem 60 could be connected to the segmented circle for variably opening and closing the segmented circle.

In addition to regulating the flow rate of aggregate by variably adjusting the position of the gate 56, the flow rate of aggregate can be adjusted by varying the speed of the motor-driven hydraulic pump 18. Increasing the speed of the motor-driven hydraulic pump 56, increases the speed of the forced air passing threw the reduction nozzle 64, and thereby increases the magnitude of the vacuum created in the vacuum chamber 50 and the flow rate of aggregate dropping from the hopper 14 into the flow path 49 of forced air. Likewise, decreasing the speed of the motor-driven hydraulic pump 18 decreases the magnitude of the vacuum and the flow rate of aggregate. Accordingly, the flow rate of aggregate to boom outlet 28 can be controlled by varying the position of the gate 56 and/or by varying the speed of the motor-driven hydraulic pump 18.

With reference now to FIGS. 7-9, the joystick 12 and its use by an operator to control the pothole patching system 10 will now be described in more detail. The joystick 12 enables an operator to use just one hand to control the pothole patching system 10 to repair a pothole. For example, using the joystick 12 to control the pothole patching system 10, the operator can move the boom assembly 20 to a position over the pothole and then inject controlled amounts and combinations of forced air, aggregate, and emulsion into the pothole.

Joystick 12, which controls movement of the boom assembly 20 and the delivery of forced air, aggregate, and emulsion, will now be described. The joystick 12 moves in at least four directions, which are represented by arrows 70, 72, 74, and 76, for control movement of the boom assembly 20. Moving the joystick 12 to the left in a manner represented by arrow 70 causes the boom to swing left in a manner represented by arrow 93, moving the joystick 12 right in a manner represented by arrow 72 causes the boom to swing right in a manner represented by arrow 92, moving the joystick 12 forward in a manner represented by arrow 74 causes the boom to extent outward in a manner represented by arrow 94, and moving the joystick 12 backward in a manner represented by arrow 76 causes the boom to retract in a manner represented by arrow 95.

The joystick 12 is equipped with pushbuttons 78 and 80 for further controlling movement of the boom assembly 20. Pressing and holding pushbutton 78 causes the boom assembly 20 to move upward, away from the road surface in a manner represented by arrow 97 of FIG. 10. On the other hand, pressing and holding pushbutton 80 lowers the boom assembly 20 toward the road surface in a manner represented by arrow 96 of FIG. 10. When either pushbutton 78 or 80 is pressed and held, the boom assembly 20 continues moving up or down until it reaches the outer limit of its range of motion or until the pressed pushbutton 78 or 80 is released.

Joystick 12 features that control the amount and combination of forced air, aggregate, and emulsion expelled from the boom assembly 20 will now be described. The illustrated joystick 12 is equipped with two additional pushbuttons 82 and 84 for controlling the flow of emulsion and aggregate, respectively. Pushbutton 82 starts and stops emulsion flow. For example, in an embodiment, when an operator presses and releases pushbutton 82, emulsion valve 39 opens and thereby permits emulsion to flow from the pressurized emulsion tank 16, through the emulsion hose 26, and to the boom outlet 28. When the operator presses and releases pushbutton 82 for a second time, the emulsion valve 39 closes and emulsion flow stops.

Pushbutton 84 starts and stops aggregate flow. For example, in an embodiment, when the operator presses and releases pushbutton 84, the gate 56 retracts to an open position, and thereby permits the vacuum in the vacuum chamber 50 to pull aggregate from the hopper 14 to the vacuum chamber 50. Once in the vacuum chamber 50, the flow path 49 of forced air entrains and carries aggregate through the wide-area opening 69 of the air receiving eductor 62, through the first conduit 44, through the aggregate-delivery tube 24 of the boom assembly 20, and out through the boom outlet 28. When the operator presses and releases pushbutton 84 a second time, the gate 56 moves to the closed position, and thereby blocks aggregate from flowing from the hopper 14 to the vacuum chamber 50.

Lights 86 and 88 are provided on the joystick 12 for indicating when valve 33 and gate 56 are in an open position. In particular, light 86 illuminates when the emulsion valve 39 is open, and light 88 illuminates when the gate 56 is in an open position. For example, in an embodiment, light 88 illuminates when the slide gate 56 is retracted and the opening 54 of the vacuum body 48 is in communication with the bottom outlet 42 the hopper 14. Lights 86 and 88 help prevent the driver from inadvertently leaving open one or both of valve 39 and gate 56 and thereby prevents the pothole patching system 10 from inadvertently expelling emulsion or aggregate out of the boom outlet 28.

The illustrated joystick 12 further includes a trigger 90 for controlling a blow out mode, which is characterized by blowing forced air, without emulsion or aggregate, out of the boom outlet 28. For example, when an operator squeezes the trigger 90, the motor-driven hydraulic pump provides the flow path 49 of forced air through first and second conduits 44 and 46, through the aggregate-delivery tube 24, and out through the boom outlet 28.

Referring now to FIGS. 7-13, an exemplary operational overview of using the illustrated pothole patching system 10 to repair a pothole will now be provided. In operation, upon identifying a pothole or an otherwise damaged road surface in need of repair, an operator positions the mobile pothole patcher 2 such that the front of the chassis 4 is proximate to the identified pothole. For example, the operator drives the mobile pothole patcher 2 like a conventional truck to a position adjacent the pothole. Then, using the joystick 12, the operator deploys the boom assembly 20. According to the embodiment illustrated in FIG. 9, the telescoping boom assembly 20 is mounted on the passenger side of the front of the chassis 4. This side-mounted arrangement provides a range of motion that is well suited for repairing highway shoulders.

In particular, when deploying the boom assembly 20, the operator moves the telescoping boom assembly 20 from a storage position to a deployed position. When in the storage position, the length of the boom assembly 20 is perpendicular to the length of the chassis 4 and rests flush against front of the mobile pothole patcher 2. The boom assembly 20 is in the storage position when the pothole patching system 10 is not be used to repair a pothole, including when an operator is driving the mobile pothole patcher 2 to the location of a pothole. When the boom assembly 20 is in the deployed position, the boom outlet 28 is located over the pothole, as illustrated in FIGS. 10-13. To move boom assembly 20 out of the storage position, the operator moves the joystick 12 to the right, as represented by arrow 72, causing the boom assembly 20 to swing right, away from the front of the chassis 4 in a manner represented by arrow 92. The operator continues moving the boom assembly 20 to the direction represented by arrow 92 until the length of the boom assembly 20 is inline with the pothole. The operator then moves the joystick 12 in forward in a direction represented by arrow direction 74 causing the boom assembly 20 to extend outward in a manner indicated by arrow 94. The operator continues moving the boom assembly 20 outward until the boom outlet 28 is positioned over the pothole. The operator then presses and holds pushbutton 80 of the joystick 12 and thereby causes the boom assembly 20 to move downward, toward the road surface in a manner represented by arrow 96 of FIG. 10. When the boom assembly 20 has been lowered to the desired height above the pothole, the operator releases pushbutton 80.

As illustrated in FIG. 10, after the boom assembly 20 has been deployed to a position over the pothole, the operator squeezes the trigger 90 of the joystick 12 and thereby causes the pothole patching system 10 to direct the forced air—free of aggregate or emulsion—out through the boom outlet 28 and into and across the pothole. For example, according to an embodiment, squeezing the trigger 90 causes the motor-driven hydraulic pump 18 to provide the flow path 49 of forced air through first and second conduits 44, 46, through the aggregate-delivery tube 24 of the boom assembly 20, and out through the boom outlet 28. The forced air removes dust, water, dirt, debris, and loose particulate from the pothole and provides a clean surface for laying a tack coating, such as is a layer of emulsion.

Next, the operator pushes and releases pushbutton 82 and thereby starts emulsion flow. In an embodiment, pressing the pushbutton 82 causes the valve 39 of the pressurized emulsion tank 16 to open. Pressure inside of the emulsion tank 16 pushes emulsion from the emulsion tank 16, through the emulsion hose 26, and to the boom outlet 28, where the flow path 49 of forced air entrains and carries the emulsion out of the boom outlet 28 and onto the bottom surface of the pothole, as illustrated in FIG. 11. While emulsion is being sprayed, the operator may cycle the joystick 12 between directions 70, 72, 74, and 76 so as to move the boom outlet 28 between various positions over the pothole and thereby ensure that a solid coat of emulsion is sprayed onto the bottom surface of the pothole.

Then, without stopping the emulsion flow, the operator pushes and releases pushbutton 84 to initiate the flow of aggregate out of the boom outlet 28, in addition to the flow of emulsion. According to an embodiment, pushing and releasing pushbutton 84 causes the hydraulically driven shaft 60 to retract the gate 56 and thereby open the opening 54 and establish communication between the vacuum chamber 50 of the vacuum body 48 and the inside of the hopper 14. As described above, a vacuum that is created in the vacuum chamber 50 pulls aggregate through the bottom outlet 42 the hopper 14 and into the vacuum chamber 50. Once in the vacuum chamber 50, the flow path 49 of forced air provided by the motor-driven hydraulic pump 18 entrains and carries the aggregate into the wide-area opening 69 of the eductor 62, through the first conduit 44, through the aggregate-delivery tube 24 of the boom assembly 20, and out through the boom outlet 28. Thus, a mixture of emulsion and aggregate is being expelled from the boom outlet 28 into the pothole, as illustrated in FIG. 12.

While the mixture of emulsion and aggregate is being expelled, the operator cycles the joystick 12 between directions represented by arrows 70, 72, 74, and 76 so as to move the boom outlet 28 between various positions over the entire area of the pothole and thereby ensure that the pothole is adequately filled with the mixture of emulsion and aggregate. As the pothole is being filled with the mixture of emulsion and aggregate, the forced air exiting the boom outlet 28 acts to compact the mixture down in the pothole. This compaction leads to a high-quality, long-lasting repair.

After the pothole has been sufficiently filled with the compacted mixture of emulsion and aggregate, the operator controls the joystick 12 to apply a finish coat of dry aggregate on top of the repaired area. To do so, the operator presses and releases pushbutton 82, which causes the emulsion valve 39 to close and thereby blocks the flow of emulsion. At this point, only aggregate is being expelled from the boom outlet 28 and onto the top of the patched pothole, as illustrated in FIG. 13. The operator then cycles the joystick 12 between directions represented by arrows 70, 72, 74, and 76 so as to direct the boom outlet 28 to spray an even coat of aggregate on top of repaired pothole.

After applying the coat of dry aggregate, the operator presses and releases pushbutton 84, which causes the hydraulic arm 60 to move the gate 56 to the closed off position. This stops the flow of aggregate in the pothole patching system 10. The operator then moves the joystick 12 so as to cause the boom assembly 20 to return to the storage position at the front of the chassis 4. Once the boom assembly 20 has been returned to the storage position, the pothole-repair operation is complete and the operator can drive the mobile pothole patcher 2 to the next pothole in need of repair.

Although the vacuum-operated material transfer system 40 is described herein as being implemented in the pothole patching system 10 that is supported on the wheeled chassis 4 of the mobile pothole patcher 2, it should be appreciated that the vacuum-operated material transfer system 40 can be implemented in other types of machines, vehicles, or mountings as well. For example, the vacuum-operated material transfer system 40 may be implemented in any fixed or mobile machine that performs an operation associated with an industry, such as mining, construction, farming, or transportation.

Specific embodiments of the invention are described herein. Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

All references to the invention or examples thereof are intended to reference the particular example being discussed at that point and are not intended to imply any limitation as to the scope of the invention generally. All language of distinction and disparagement with respect to certain features is intended to indicate a lack of preference for those features, but not to exclude such from the scope of the invention entirely unless otherwise indicated. All methods described herein can be performed in any suitable order unless otherwise indicated herein or otherwise clearly contradicted by context. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A system provided on a pothole patcher for creating a vacuum that pulls aggregate out of a hopper and into a flow path of forced air that is provided by an air source and extends through a forced air flow path outlet, the system comprising:

a vacuum chamber formed in a vacuum body and disposed proximate to the hopper;

a valve disposed between the vacuum chamber and the hopper, the valve configured to open and close for permitting and blocking communication between the vacuum chamber and the hopper;

a reduction nozzle in communication with and provided between the air source and the vacuum chamber, wherein the reduction nozzle is configured to create a vacuum in the vacuum chamber by reducing the pressure of the forced air entering the vacuum chamber; and an air receiving eductor in communication with and provided between the vacuum chamber and the forced air flow path outlet, wherein the vacuum pulls aggregate from the hopper to the vacuum chamber when the valve is open.

2. The system of claim 1, wherein the reduction nozzle increases the velocity of the forced air that flows into the vacuum chamber.

3. The system of claim 2, wherein the eductor comprises a section including a first end and a second end, each end defining an opening, the area of the first end opening being larger than the area of the second end opening, the first end opening being a wide-area opening proximate to the vacuum chamber, wherein the increased-velocity forced air entrains and carries aggregate from the vacuum chamber into the wide-area opening and then to the forced air flow path outlet.

4. The system of claim 3, wherein the vacuum body further comprises:

a top surface disposed between the vacuum chamber and the hopper; and an opening formed in the top surface and positioned inline with an outlet of the hopper, wherein the opening provides communication between the hopper and the vacuum chamber.

5. The system of claim 4, wherein the valve includes a retractable gate provided on the top surface and configured to slide coplanar to the top surface between open and closed positions.

6. The system of claim 5, wherein, when the gate is in the open position, the outlet of the hopper and the opening of the vacuum body are in communication and the vacuum pulls aggregate from inside the hopper, through the outlet of the hopper, through the opening of the vacuum body, and into the vacuum chamber.

7. The system of claim 1, wherein the eductor comprises:

a first frusto-conical section and a second frusto-conical section, each frusto-conical section including a large opening end and a small opening end; and a middle section including a first end and a second end, wherein the first end is connected to the small opening end of the first frusto-conical section and the second end is connected to the small opening end of the second frusto-conical section, wherein the large opening end of the second frusto-conical section is proximate to the vacuum chamber.

8. The system of claim 7, wherein the first frusto-conical section large opening end has a diameter of from about 2 inches to about 3.5 inches and the first frusto-conical section small opening end has a diameter of from about 1.5 inches to about 2.5 inches, and wherein the second frusto-conical section large opening end has a diameter of from about 2.5 inches to about 4 inches and the second frusto-conical section small opening end has a diameter of from about 1 inch to about 3 inches.

9. A vacuum-operated material transfer system for use on a pothole patcher, the pothole patcher is equipped with a hopper for storing aggregate, an air source for providing a flow path of forced air, and a boom assembly for dispensing aggregate through a boom outlet, the vacuum-operated material transfer system is configured to create a vacuum that pulls aggregate out of an outlet of the hopper and into the flow path of forced air provided by the air source, the forced air entrains and carries aggregate to the boom assembly, the system comprising:

a vacuum body disposed proximate to the outlet of the hopper, the vacuum body comprising:

a vacuum chamber;

a surface disposed between the vacuum chamber and the hopper; and an opening formed in the surface and positioned inline with the outlet of the hopper, the opening provides communication between the hopper and the vacuum chamber;

a slide gate slidably mounted on the surface of the vacuum body and movable between open and closed positions, the open position permits communication between the hopper and the vacuum chamber, the closed position blocks communication between the hopper and the vacuum chamber;

a reduction nozzle disposed between the vacuum chamber and the air source, the reduction nozzle is configured to create the vacuum inside of the vacuum chamber by reducing the pressure and increasing the velocity of the forced air flowing from the air source into the vacuum chamber, the vacuum pulls aggregate through the outlet of the hopper, through the opening of the vacuum body, and into the vacuum chamber; and a flow path section including a first end and a second end, each end defining an opening, the area of the first end opening being larger than the area of the second end opening and in communication with the second end opening, the first end opening being a wide-area opening in communication with and proximate to the vacuum chamber and in communication with the boom outlet, wherein the increased-velocity forced air exiting the reduction nozzle entrains and carries aggregate from the vacuum chamber into the wide-area opening and then to the boom outlet.

10. The system of claim 9, further comprising:

first and second conduits, wherein the vacuum body interconnects the first and second conduits.

11. The system of claim 10, wherein the first conduit extends between the vacuum body and the boom assembly and is fitted with an air receiving eductor that comprises the flow path section that defines the wide-area opening.

12. The system of claim 11, wherein the second conduit extends between the vacuum body and the air source and is fitted with the reduction nozzle.

13. The system of claim 12, wherein the first and second conduits combine to transmit forced air from the air source, through the vacuum chamber, and to the boom assembly.

14. The system of claim 9, wherein the surface of the vacuum body is attached to a bottom of the hopper such that the opening of the surface juxtaposes the outlet of the hopper.

15. The system of claim 9, wherein the vacuum body is formed integrally with the hopper such that the opening of the surface and the outlet of the hopper are a single opening.

16. The system of claim 9, wherein the slide gate is configured to slide coplanar to the surface of the vacuum body between the open and closed positions.

17. The system of claim 13, further comprising:

an emulsion tank configured to dispense emulsion into the flow path of forced air in the first conduit.

18. The system of claim 17, wherein the flow path of forced air carries a mixture of emulsion and aggregate to the boom assembly.

19. A method for using a vacuum-operated material transfer system that is installed on a pothole patcher, the pothole patcher comprising a hopper for storing aggregate, an air source for providing a flow path of forced air, and a boom assembly for dispensing aggregate through a boom outlet, the method comprising:

creating a low-pressure area inside of a vacuum chamber that is formed in a vacuum body and disposed proximate to an outlet of the hopper by controlling the air source to provide the flow path of forced air through a reduction nozzle and into the vacuum chamber;

permitting the low-pressure area inside of the vacuum chamber to pull aggregate from the hopper by opening a valve that is disposed between the vacuum chamber and the hopper and that is configured to open and close for permitting and blocking communication between the vacuum chamber and the hopper; and increasing the velocity of the forced air inside of the vacuum chamber by controlling the air source to provide the flow path of forced air through the reduction nozzle and into the vacuum chamber such that the increased-velocity forced air entrains and carries aggregate from the vacuum chamber into a wide-area opening and then to the boom assembly, the wide-area opening defined by a flow path section including a first end and a second end, each end defining an opening, the first end opening being the wide-area opening and being larger than the area of the second end opening, the wide-area opening being proximate to the vacuum chamber, in communication with the second end opening, and in communication with the boom outlet.

20. The method of claim 19, wherein the flow path section that defines the wide-area opening forms a portion of an air receiving eductor.

21. The method of claim 20, further comprising:

controlling an emulsion tank to dispense emulsion into the flow path of forced air that is exiting the vacuum chamber and that has aggregate entrained therein.

22. The method of claim 21, further comprising:

controlling the boom assembly to direct the flow path of forced air, including the aggregate and emulsion entrained therein, into a pothole.

23. A pothole patching system mounted on a vehicle having a wheeled chassis, the pothole patching system comprising:

a boom assembly mounted on an end of the wheeled chassis and having a boom outlet on an end thereof;

a hopper in communication with the boom assembly and configured to store aggregate;

an air source in communication with the boom assembly and the hopper and configured to provide a flow path of forced air that carries aggregate from the hopper to the boom assembly; and a vacuum-operated material transfer system that configured to create a vacuum proximate to an outlet of the hopper that pulls aggregate out of the hopper and into the flow path of forced air provided by the air source, the vacuum-operated material transfer system comprises:

a vacuum chamber formed in a vacuum body and disposed proximate to the outlet of hopper;

a valve disposed between the vacuum chamber and the outlet of hopper, the valve configured to open and close for permitting and blocking communication between the vacuum chamber and the hopper;

a reduction nozzle provided between the air source and the vacuum chamber and configured to create the vacuum in the vacuum chamber by reducing the pressure of the forced air entering the vacuum chamber; and a flow path section including a first end and a second end, each end defining an opening, the area of the first end opening being larger than the area of the second end opening and in communication with the second end opening, the first end opening being in communication with and proximate to the vacuum chamber and in communication with the boom outlet, wherein the vacuum created by the vacuum-operated material transfer system pulls aggregate from the outlet of the hopper to the vacuum chamber and the flow path of forced air provided by the air source entrains and carries aggregate through the flow path section to the boom outlet of the boom assembly.

24. The system of claim 23, wherein the wheeled chassis supports an operator cabin that is equipped with a joystick including a trigger, a first pushbutton, a second pushbutton, or a combination thereof mounted to the joystick, wherein the joystick enables a single operator to control operation of the pothole patching system from within the cabin with one hand without releasing the joystick from that hand.

25. The system of claim 23, wherein the boom assembly further comprises: an aggregate-delivery tube disposed between the vacuum chamber and the boom outlet.

26. The system of claim 19, wherein the flow path section forms a portion of an air receiving eductor.

27. A method for using a joystick to control a pothole patching system to repair a road surface, wherein the pothole patching system includes a hopper for storing aggregate, an emulsion tank for storing emulsion, a hydraulic pump for providing a flow path of forced air, and a boom assembly for delivering emulsion and aggregate to a repair area of the road surface, the method comprising:

moving the joystick to move the boom assembly to a position over the repair area;

squeezing a trigger of the joystick to direct the flow path of forced air out of the boom assembly and to the repair area;

providing a coat of emulsion on a surface of the repair area by pushing a first pushbutton of the joystick to open a valve associated with the emulsion tank and permit emulsion to flow out of the boom assembly and to the repair area;

filling the repair area with a mixture of emulsion and aggregate by pushing a second pushbutton of the joystick to open a valve associated with the hopper and permit the flow path of forced air to carry aggregate out of the boom assembly and to the repair area, wherein emulsion and aggregate are flowing from the boom assembly to the repair area;

providing a layer of aggregate on top of the mixture of emulsion and aggregate by pushing the first pushbutton of the joystick to close the valve associated with the emulsion tank, wherein the flow path of forced air continues to carry aggregate out of the boom assembly and to the repair area; and pushing the second pushbutton of the joystick to close the valve associated with the hopper and stop the flow of aggregate out of the boom assembly, wherein the joystick, the trigger, the first pushbutton, and the second pushbutton are configured to be actuated to control operation of the pothole patching system when gripped by one hand of an operator without releasing the joystick from that hand.

28. The method of claim 27, wherein the valve associated with the hopper comprises:

a retractable gate provided between an outlet of the hopper and a vacuum chamber, wherein the retractable gate is configured to between a closed position that blocks communication between the hopper and the vacuum chamber and an open position that permits communication between the hopper and the vacuum chamber.

29. The method of claim 28, wherein a pressure differential between the hopper and the vacuum chamber creates a vacuum in the vacuum chamber that pulls aggregate through a bottom outlet of the hopper and into the vacuum chamber when the retractable gate is in the open position.

30. The method of claim 29, wherein pushing the second pushbutton of the joystick causes a hydraulically driven shaft to move the retractable gate from the closed position to the open position and thereby permit the vacuum in the vacuum chamber to pull aggregate from the hopper to the vacuum chamber.

31. The method of claim 30, wherein, once aggregate is in the vacuum chamber, the flow path of forced air provided by the hydraulic pump entrains and carries the aggregate to and out of the boom assembly.

* * * * *